United States Patent [19]

Shimodaira

[11] 4,303,013

[45] Dec. 1, 1981

[54] MICRO-PRINTER WITH UNITARY PLASTIC FRAME

[75] Inventor: Tadayoshi Shimodaira, Shiojiri, Japan

[73] Assignees: Kabushiki Kaisha Suwa Seikosha; Shinsu Seika Kabushiki Kaisha, both of Tokyo, Japan

[21] Appl. No.: 12,780

[22] Filed: Feb. 16, 1979

[30] Foreign Application Priority Data

Feb. 16, 1978 [JP] Japan ..... 53-16876

[51] Int. Cl.[3] ..... B41J 1/48

[52] U.S. Cl. ..... 101/99; 400/694; 101/93.22

[58] Field of Search ..... 101/93.48, 95, 96, 99, 101/110, 93.22; 400/690, 693, 694, 154

[56] References Cited

U.S. PATENT DOCUMENTS

| | | | |
|---|---|---|---|
| 3,837,456 | 9/1974 | Ruskin | 400/694 X |
| 3,920,113 | 11/1975 | Tamai | 101/93.48 X |
| 3,949,664 | 4/1976 | Shimodaira et al. | 101/99 X |
| 4,033,256 | 7/1977 | Hanaoka | 101/99 |
| 4,104,967 | 8/1978 | Okabe | 101/99 |
| 4,111,117 | 9/1978 | Tezuka et al. | 101/99 |
| 4,150,903 | 4/1979 | Bailey et al. | 400/694 X |
| 4,164,181 | 8/1979 | Hanaoka | 101/99 |
| 4,165,687 | 8/1979 | Tezuka | 101/99 X |

*Primary Examiner*—Edward M. Coven

*Attorney, Agent, or Firm*—Blum, Kaplan, Friedman, Silberman & Beran

[57] ABSTRACT

A light-weight micro-printer including a one piece molded plastic main frame is provided. The printer frame includes two substantially parallel side frames spaced apart from each other a distance of the width of a print paper with integrally molded support members between the side frames. The support members function as a paper guide member and isolate an electromagnet disposed within the frame.

13 Claims, 4 Drawing Figures

MICRO-PRINTER WITH UNITARY PLASTIC FRAME

BACKGROUND OF THE INVENTION

This invention relates generally to a micro-printer, and in particular to a micro-printer of low power consumption including a one piece molded plastic frame. In conventional printers which use metal frames, miniaturization beyond a certain point becomes difficult as it is necessary to provide screws, snap rings and the like for securing the frame. In addition, special processing required is inefficient and often involves plating, heat treatment and the like. As a practical matter, one such conventional printer, such as an electronic table calculator with a metal frame is heavy and can only be utilized as a table model due to its heavy weight.

Accordingly, it would be desirable to provide a miniaturized printer which overcomes the above noted shortcomings of conventional printers using metal frames. It should be noted that this cannot be accomplished simply by substituting a one piece molded plastic frame in place of the conventional metal frame. That is to say, for purposes of making a printer main frame of one piece by using plastic, it is necessary to satisfy two extremely important conditions. The first is that the printer be one which can be driven by low power consumption. This is required because the rigidity of a plastic frame is not as great as a metal frame. The resistance to the coefficient of pressure and velocity (hereinafter referred to as PV-value) on shafts or bearings which are molded into the one piece frame must be small. Thus, it is necessary to reduce or average the load required for the main operations of a printer, such as character selection, printing, paper feeding, etc. in a printer arranged in accordance with the invention. In addition, a printer with a one-piece molded plastic frame must be capable of being extremely small in size. If a one piece molded plastic frame of the same size as a conventional metal frame is employed in place of the conventional metal frame, significant problems will arise. For example, the cost of materials will increase due to the large size, and molding costs increase because individual molds are large and it is not possible to use a mold having multiple cavities. In addition, the molding shot cycle is long because it takes substantial time for pouring the material into the mold and chilling it. Thus, merely substituting a plastic frame would result in a product which is inferior to the metal frame in terms of manufacturing costs.

SUMMARY OF THE INVENTION

Generally speaking, in accordance with the invention, a micro-printer wherein the printer frame is a one-piece molded plastic frame is provided. The printer frame includes two substantially parallel side frames spaced apart from each other at a distance of the width of a print paper. Support members forming a lower portion of the frame are integrally molded with the side frames for providing a one piece construction. The energy necessary for printing one letter is less than 20 gr-cm which applies stress to mechanical elements of the printing mechanism within the critical strength of the plastic frame. The support members disposed between the side frames are shaped to function as a paper guide and as an isolating member for isolating an electromagnet disposed within the frame from magnetically attractable material outside the printer. In addition, the periphery of the side frames is formed with outwardly extending ribs for increasing the strength of the side frames.

Accordingly, it is an object of the invention to provide an improved miniaturized printer.

Another object of the invention is to provide a micro-printer which does not require special processing during assembly.

A further object of the invention is to provide an improved micro-printer having a reduced number of parts and which is more easily assembled.

Still another object of the invention is to provide a light-weight printer suitable for use as a portable or hand-held printer.

Still a further object of the invention is to provide a micro-printer including a one-piece molded plastic frame.

Another object of the invention is to provide a micro-printer including a rotating print character wheel.

Still another object of the invention is to provide an improved micro-printer requiring low power consumption.

Still a further object of the invention is to provide a one-piece plastic frame for a micro-printer having integrally molded bearing surfaces.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
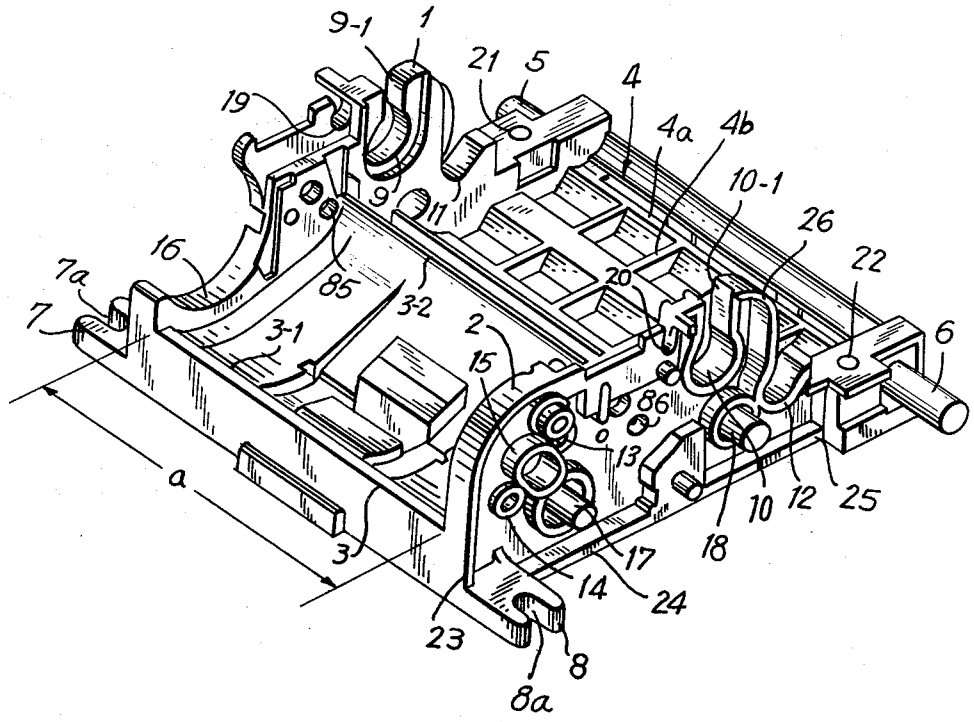
FIG. 1 is a perspective view of a one-piece molded plastic frame for a micro-printer constructed and arranged in accordance with the invention.

Referring now to FIG. 1, a perspective view of a one piece molded plastic frame for a micro-printer constructed and arranged in accordance with the invention is shown. The frame includes a first side frame 1 and a second side frame 2, substantially parallel to each other and spaced apart a distance a of the width of a print paper. A paper guide portion 3 is a supporting member between first side frame 1 and second side frame 2. Paper guide 3 is formed with an outwardly facing concave surface having a paper guide entrance 3-1 at the forward end of paper guide 3 and a paper guide exit 3-2 disposed at the back side of paper guide 3 midway in the frame. A print paper 69 is guided along the concave surface of paper guide 3. The concave surface of paper guide 3 serves to increase the rigidity of the frame and is integrally molded with side frames 1 and 2.

The frame includes an isolation region 4 formed from a series of beams 4*a* perpendicularly disposed between first side frame 1 and second side frame 2 and a plurality of ribs 4*b* perpendicularly disposed to beams 4*a*. Beams 4*a* and ribs 4*b* are adapted to provide a distance between electromagnet means to be disposed within the interior of the frame and magnetically attractable material outside of the printer. In addition, beams 4*a* serve for combining first side frame 1 and second side frame 2.

The forward end of the frame is provided with a pair of proposed projecting mounting feet 7 and 8 on first side frame 1 and second side frame 2, respectively. Mounting feet 7 and 8 are each formed with an opening 7*a* and 8*a* respectively, for receiving a fastener therethrough. The rear end of the printer frame is formed with a pair of opposed mounting pins 5 and 6 on first side frame 1 and second side frame 2, respectively, for mounting the frame to an outer shell (not shown).

Figure 2:
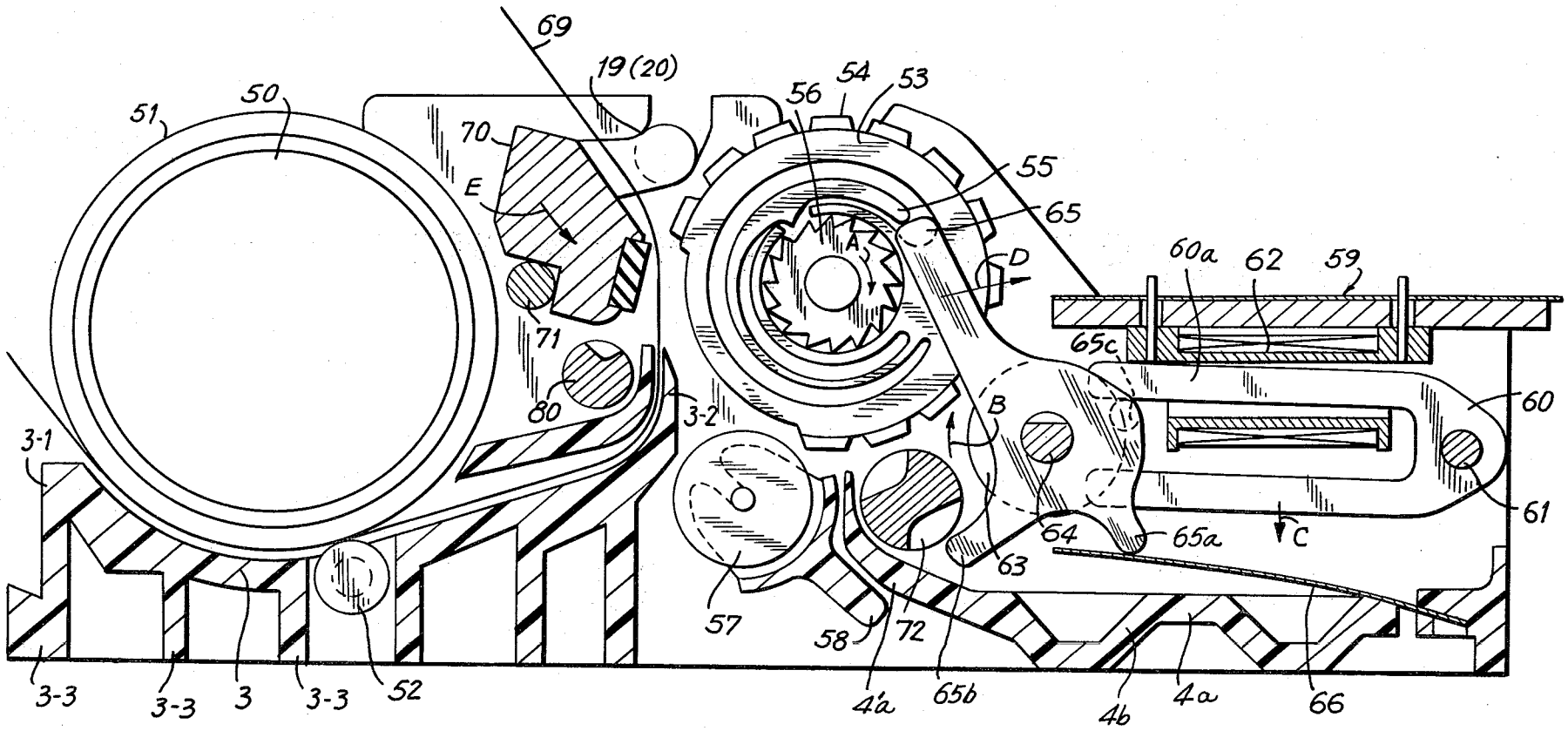
FIG. 2 is a sectional view depicting a micro-printer including a one-piece molded plastic frame as illustrated in FIG. 1.

Referring now to FIGS. 1 and 2, first side frame 1 and second side frame 2 are each formed with a character ring bearing 9 and 10 therein, respectively, for rotatably supporting a character ring 53. Character ring bearings 9 and 10 are each formed with an opening 9-1 and 10-1, respectively, so that character ring 53 may be removed and replaced even after character ring 53 is assembled on a character ring shaft 56. First side frame 1 and second side frame 2 are each further formed with a pawl bearing 11 and 12, respectively, disposed rearwardly behind character ring bearing 9 and 10 for rotatably supporting a selecting pawl 65 which is mounted on a selecting pawl shaft 64.

A pair of cooperating motor screw holes 13 and 14 are formed in a forward region of second side frame 2 for fixing a motor 50 between side frames 1 and 2. Second side frame 2 is also formed with a motor shaft opening 15 between screw holes 13 and 14 for providing power to a gear train (not shown) disposed on the outside of side frame 2. First side frame 1 is formed with an open bearing 16 for supporting a paper feeding drum 51 disposed on the periphery of motor 50.

Second side frame 2 is further formed with integrally molded one piece forward gear shaft 17 and a rearward gear shaft 18 for mounting gear wheels from the gear train thereon. A print hammer bearing portion 19 and 20 is formed in each first side frame 1 and second side frame 2 for hanging a print hammer 70 thereon. The rear of each first side frame 1 and second side frame 2 is formed with a starting hole 21 and 22, respectively, for tapping screws therein for fixing a trigger electromagnet 59 to the frame.

The periphery of second side frame 2 is formed with outwardly projecting ribs shown as 23, 24, 25 and 26 for increasing the rigidity of side frame 2. Similar outwardly projecting ribs are also provided along the periphery of first side frame 1. Thus, a constructional outline of the one piece molded plastic frame for a micro-printer constructed and arranged in accordance with the invention has been set forth. The general size of such a printer is 30 mm in height, 70 mm in width and 70 mm in depth. Thus, the size has been reduced to about $\frac{1}{3}$ compared with a conventional printer having the same type of performance which utilizes a metal frame.

Turning now to FIG. 2, the invention will be described with respect to the miniaturization and low power consumption of the micro-printer. FIG. 2 is a side sectional view of a micro-printer including a one piece molded plastic frame constructed and arranged in accordance with the invention. Motor 50 is disposed within the concave surface of paper guide 3 and has paper feeding drum 51 disposed on the periphery thereof. A pressing roller 52 for pressing a print paper 69 against paper feeding drum 51 is disposed within paper guide 3. By this arrangement. space is favorably conserved in that motor 50 is disposed within paper feeding drum 51. The forward region of the frame beneath paper guide portion 3 is provided with ribs 3-3 for increasing the strength of the printer frame in this region.

Turning now to the print character selection, character ring 53 including a plurality of characters 54 disposed on the periphery thereof is formed with an integral character ring pawl 55 which biases towards the central axis of character ring 53. Character ring 53 is mounted on character ring shaft 56 of the chrysanthemum petal-shape which is rotatably supported on character ring bearings 9 and 10 of first side frame 1 and second side frame 2, respectively. An inkroll 57 is rotatably mounted within an inkroll case 58 disposed below character ring 53.

Isolation region 4 of the printer frame presents a partly concave forward region 4'*a* and a partially W-shaped region formed by beams 4*a* and ribs 4*b* so that the rigidity of the frame is this region is increased. A trigger electromagnet coil 59 is mounted in the frame in isolation region 4 and includes a bracket (]-) shaped core 60 which is capable of rotating around a shaft 61 and an electromagnetic coil 62 which surrounds an upper arm 60*a* of ]-shaped core 60. First arm 60*a* is maintained in contact with a disc 63 formed of a magnetic material which is fixed to a shaft 64 and rotates as a single body with shaft 64. Selecting pawl 65 is rotatably supported on shaft 64 and is engaged with a ]-shaped core 60 by a pin 65C engaged by first arm 60*a* so as to be driven in the direction of an arrow D when ]-shaped core 60 rotates in the direction of an arrow C. Shaft 64 is rotatably supported on pawl bearings 11 and 12 of first side frame 1 and second side frame 2, respectively.

The trigger assembly of the printer operates as follows. When electromagnetic coil 62 is energized in response to a signal from a print control circuit (not shown) ]-shaped core 60 rotates in the direction of arrow C by the attractive force between ]-shaped core 60 and disc 63 which is rotated in the direction of arrow B. With this rotational movement, selecting pawl 65 is rotated in the direction of arrow D from a first position towards the axis of character ring 53 to a second position away from the axis of character ring 53. During this displacement, the engagement between selecting pawl 65 and character ring pawl 55 is released so that character ring 53 rotates in the direction of arrow A together with character ring shaft 56. Rotation of character ring 53 continues until the selected character is brought into contact with inkroll 57 at a printing position. Selecting pawl 65 is returned to its first position towards the axis of character ring 53 by the resetting action of a resetting spring 66 against a resetting projection 65*a* formed on the lower end of selecting pawl 65. Selecting pawl 65 is also formed with a stop 65*b* for engaging a post 72 for limiting displacement of selecting pawl 65 to its second position in the direction of arrow B.

Selected character 54 at rest in the printing position is printed when hammer 70 hung on hammer bearing portions 19 and 20 is displaced in the direction of an arrow E. Hammer 70 is displaced from a first at rest position away from character ring 53 to a second print position towards character ring 53 by displacement of a shaft 71. This action will be described in more detail with respect to FIG. 3. When hammer 70 is displaced to its second print position, print paper 69 is pressed against selected character 54. Following this printing operation, paper feeding drum 51 rotates intermittently, and printed print paper 69 is fed by an incremental amount of one line whereby a series of print actions may be performed.

In utilizing the above described print action, the power consumption of the printer comes into question when providing a frame constructed and arranged in accordance with the invention. Thus, the particular features of the assembly wherein the mechanical load increases due to the selecting operation and the printing operation will be described in accordance with the following exemplary embodiment.

The selecting mechanism which selects desired print character 54 on character ring 53 is driven with extremely low power consumption. As noted in connection with the description of FIG. 2, ]-shaped core 60 and disc 63 constitute a magnetic circuit in trigger electromagnet 59. As ]-shaped core 60 and disc 63 rotate in opposite directions and are in contact at all times, in order to drive the printer it is sufficient to energize electromagnetic coil 62 by a voltage of 4 V and a current of 50 mA. This to be compared to a conventional trigger mechanism wherein an iron piece is attracted within a conventional frame by a voltage of 17 V and a current of 250 mA. By this comparison it can be seen how small the power consumption is of a printer constructed and arranged in accordance with the invention. This printer can be driven with such low power consumption because the power consumption of this printer is about 1/20th of the power consumption of a convention printer, if the pulse width is the same.

The fact that the trigger mechanism may be driven with such low power consumption means that low-priced electronic parts for controlling the trigger mechanism are sufficient. In this case, the power source for driving the trigger mechanism can be made low priced and small sized because the current required is maintained at a very low level. Thus, for example, a hand-held calculator with a printer can be easily driven by the power source of the R-6 Mn (manganese) type cell.

In all printer mechanisms, the print hammer applies the greatest mechanical load to the mechanical elements of the printer. Thus, reduction of this mechanical load is the key for possibly employing plastic parts in the printer. In a printer constructed and arranged in accordance with the invention, an inkroll is utilized as inking means for the print character, thereby further reducing the energy necessary for printing one letter.

Figure 3:
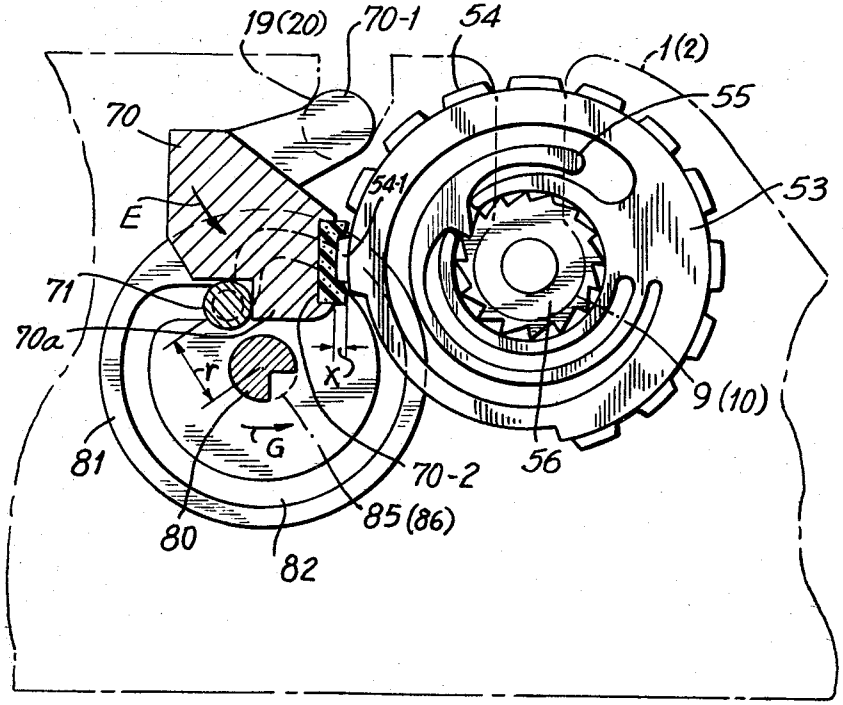
FIG. 3 is a partial side sectional view of the printer illustrated in FIG. 2.

Turning now to FIG. 3, the hammer mechanism illustrated in FIG. 2 is shown in more detail. Hammer 70 is rotated about a hammer shaft 70-1 as a fulcrum in the direction of arrow E to its second print position against a selected character 54-1 which is at rest at the printing position. Rotation of hammer 70 is performed by displacement of shaft 71 disposed against a downwardly extending lip **70*a* of hammer 70. Shaft 71 is displaced in camming fashion by the rotation in a direction illustrated by an arrow G of a grooved cam 81 secured on a cam shaft 80 having a grooved cam 82 in engagement with shaft 71. An elastic member 70-2 provided on a printing surface of hammer 70 is pressed against selected character 54-1 whereby printing occurs on print paper 69**.

Figure 4:
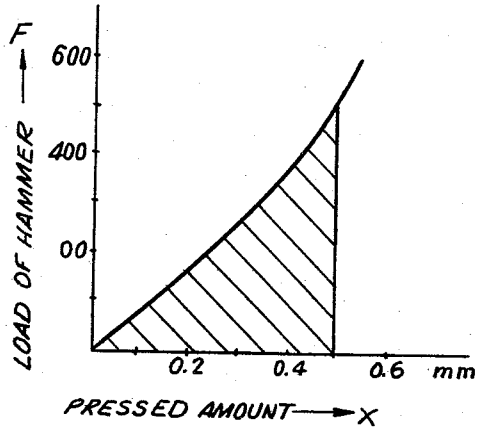
FIG. 4 is a graphical illustration showing the load upon the hammer in the hammer mechanism of the printer illustrated in FIGS. 2 and 3.

For purposes of illustration, assume that the displacement or pressed amount of hammer 70 is X and the load on hammer 70 is F, the relationship is illustrated graphically in FIG. 4. The energy required to print one letter at this time corresponds to the oblique line portion shown in the graph and the value is approximately 500 gr $\times 0.05$ cm $\times \frac{1}{2} = 12.5$ gr-cm. This energy is about 1/6th compared with the energy requirement of 50 to 80 gr-cm in a conventional printer utilizing the same size character ring.

Hammer 70 which applies this printing energy applies a load to hammer bearing portions 19 and 20 on which are hung hammer 70 through hammer shaft 70-1. In addition, a load is applied to bearings 85 and 86 for rotating cam shaft 80 carrying grooved cam 81. The pressure and velocity coefficient of bearings 85 and 86, namely the PV value, which is the critical standard for the design of bearings, is as follows. Assume that the number of characters 54 on character ring 53 is 18, the printing speed is 2.5 lines per second, the diameter of shaft 80 is 4 mm, the length of the bearing is 2 mm and the load of hammer 70 is $500 \times 18$ gr and that 60% of the load of hammer 70 is applied to bearings 85 and 86 and 40% thereof is applied to hammer bearings 19 and 20, the load on bearings 85 and 86 is as follows:

$P = 34$ kg/cm$^2$ $V = 1.9$ m/min $\therefore PV = 64.6$ Kg/cm$^2$ - m/min

This PV value must be compared to the maximum permissible PV-value of polyacetyl, one of the engineering plastics, in a non-lubricating condition which is about 100 kg/cm$^2$-m/min when the slippage velocity is about 2 m/min. In a printer, since initial lubricity can be expected, the maximum PV-value doubles, so that a safety coefficient of about three to four times the maximum permissible PV-value is obtained for bearings 85 and 86.

In connection with character ring bearings 9 and 10 on which character ring shaft 56 is mounted, 100% of the pressure from hammer 70 is transmitted through character ring 53. If at the time of printing, character ring shaft 56 is temporarily stationary, it is unnecessary to be concerned about the PV-value. Accordingly, it is sufficient that the compressive stress be within the permissive value, a limitation which is relatively easily achieved.

As shown in FIG. 3, the hammer assembly is constructed and arranged so that hammer 70 is driven in response to the camming action of groove cam 81. When the maximum load for printing is applied to hammer 70, a distance r between grooved cam shaft 80 and shaft 71 pressing hammer 70 to its print position is at a minimum. Thusly, the torque load for the rotation of cam 81 can be reduced to an extremely small value. Since the maximum load of a printer utilizing a character ring occurs at the time of printing, reduction of load torque during printing enables the use of a motor with low output as a driving source. In addition, the PV-value of the printer shafts and bearings in the gear train driven by the motor are also reduced to a low value.

Accordingly, a printer constructed and arranged in accordance with the invention enables the printer frame to be made of plastic material, whereby the shafts and bearings in the gear train, the paper guide and other regions can be molded as part of the printer frame. By utilizing such a one-piece molding, screws for assembling these parts are unnecessary and space for receiving and fastening these screws also is unnecessary. Thus, such a printer constructed and arranged in accordance with the invention, can be reduced in size and weight.

As set forth in detail above, by providing a selecting mechanism for the printer which may be driven at low power and providing a hammer wherein the mechanical load during printing is reduced, a one-piece molded plastic frame constructed and arranged in accordance with the invention can be utilized. Further, by utilizing this construction, a reduction in the number of parts and simplification during assembly is also attained. Thus, a low-price micro-printer of small size and light weight can be provided.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described, and all statements of the scope of the invention which, as a matter of language might be said to fall therebetween.

What is claimed is:

1. A miniaturized printer for printing on a print tape comprising:

a one piece plastic printer frame of a given critical strength including two substantially parallel side frames spaced apart from each other a distance of the width of a print tape, said frame formed with integrally molded support means disposed between side frames for supporting said side frame, said support means including a concave shaped print tape guide member for guiding the print tape through said printer frame;

said side frame further formed with motor support means for supporting a motor within the concave region of said concave guide member and a motor mounted on said motor support means;

said motor being substantially cylindrical and further including a tape feeding drum mounted on the periphery of said motor for feeding a print tape said through said tape guide member;

at least one character ring having print characters on the periphery thereof, said ring rotatably mounted between said side frames;

character selection means for selectively aligning one of said print characters in a printing position; and print hammer means including a print hammer pivotally mounted between said side frames and adapted to be selectively displaced between a first at rest position away from a print tape and a second print position impacting a print tape into said selected print character, the stress applied to said side frames wherein said print hammer means is mounted being within the critical strength of said plastic printer frame.

2. The miniaturized printer of claim 1, wherein said concave shaped tape guide member includes a plurality of ribs perpendicularly disposed between side frames on the outer surface of said tape guide member for increasing the strength of said plastic frame.

3. The miniature printer of claim 1, wherein said side frames are formed with cooperating character ring bearing surfaces and said character selection means includes engaging means for selectively rotating said print character ring until a selected print character is in a print position adjacent to a print tape.

4. The miniature printer of claim 3, wherein said character selection means further includes drive means for selectively rotating said character ring and said engaging means includes pawl means pivotally mounted between said side frames, said pawl means operatively engageable with said rotatable print character ring in response to said drive means and electromagnetic means operatively engaged with said pawl means for selectively rotating and stopping rotation of said rotatable character ring by pivoting said pawl means into and out of engagement with said character ring.

5. The miniature printer of claim 4, wherein said engaging means further includes a rotating character ring shaft and spring means coupled to said character ring and biased towards a first position towards the shaft of said character ring for engaging said shaft for rotating said character ring, said spring means displaceable away from said shaft by said pawl means to a second position out of engagement with said shaft for stopping rotation of said character ring.

6. The miniature printer of claim 5, wherein said electromagnetic means includes a selectively operable trigger electromagnet having an electromagnetic coil mounted between said side frames and a ]-shaped core pivotally mounted between said side frames with one arm of said core disposed within said coil for selective displacement of said core and said pawl means is a pawl pivotally mounted between said side frames operatively engaged by said one arm of said core for selective displacement of said pawl from a first position towards said pring character ring in engagement with a spring means for preventing rotation of said character ring and a second position away from the shaft of said print character ring to displace said spring means to its second position in engagement with said shaft for rotating said print character ring in response to energization of said electromagnetic coil until the selected print character is in a print position adjacent said print tape and said pawl is returned to said first position for stopping the rotation of said character ring by displacing said spring means to the second position out of engagement with said shaft.

7. The miniature printer of claim 4, wherein said supporting means include rib means disposed between said side frames adjacent said electromagnetic means for isolating the electromagnetic means from attractable material outside said printer.

8. The miniature printer of claim 3, wherein said side frames are formed with a pair of cooperating print hammer bearing surfaces and said print hammer means includes a print hammer pivotally mounted between said print hammer bearing surfaces, said print hammer selectively displaceable between a first position away from said print character ring and a second print position towards said print character ring and in contact with said selected print character and a print position.

9. The miniature printer of claim 8, wherein said print hammer includes a deformable impact region disposed for impacting said selected print character when said hammer is displaced to its second print position.

10. The miniature printer of claim 9, including a grooved cam rotatably mounted between said side frames and a cam follower means engageable with said print hammer for selectively displacing said print hammer from its first position to its second print position in response to rotation of said grooved cam.

11. The miniature printer of claim 10, wherein the stress applied to said print hammer bearing surfaces of said side frames during printing is less than 20 gr-cm.

12. The miniature printer of claim 1, wherein the side frames are molded with outwardly extending ribs about the periphery of said side frames for increasing the strength of said printer frame.

13. The miniature printer of claim 1 or 11, wherein said print hammer means is selectively actuated to print at a time said character selection means is stationary.

* * * * *